US006700464B2

(12) United States Patent
Ling et al.

(10) Patent No.: US 6,700,464 B2
(45) Date of Patent: Mar. 2, 2004

(54) LOW COST HIGH SPEED BOARD-TO-BOARD COAXIAL CONNECTOR DESIGN WITH CO-PLANAR WAVEGUIDE FOR PCB LAUNCH

(75) Inventors: Yun Ling, Portland, OR (US); Thomas G. Ruttan, Lake Oswego, OR (US); Daniel T. Tong, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 85 days.

(21) Appl. No.: 10/081,515

(22) Filed: Feb. 21, 2002

(65) Prior Publication Data

US 2003/0155989 A1 Aug. 21, 2003

(51) Int. Cl.[7] ..... H01P 1/04
(52) U.S. Cl. ..... 333/260
(58) Field of Search ..... 333/33, 260, 157, 333/160

(56) References Cited

U.S. PATENT DOCUMENTS

| | | | | | |
|---|---|---|---|---|---|
| 5,417,578 | A | * | 5/1995 | Mroczkowski et al. | 439/101 |
| 5,481,073 | A | * | 1/1996 | Singer et al. | 200/1 R |
| 5,530,623 | A | * | 6/1996 | Sanwo et al. | 361/788 |
| 5,807,117 | A | * | 9/1998 | Kempf et al. | 439/63 |
| 5,828,272 | A | * | 10/1998 | Romerein et al. | 333/100 |
| 6,099,322 | A | * | 8/2000 | Beloritsky et al. | 439/63 |

* cited by examiner

*Primary Examiner*—Patricia Nguyen
(74) *Attorney, Agent, or Firm*—Blakely, Sokoloff, Taylor & Zafman LLP

(57) ABSTRACT

An apparatus comprising a direct board-to-board coaxial connection fabricated from metal parts that have been stamped and formed is disclosed. The connection allows direct board-to-board coaxial connections with a low cost and ease of manufacturing.

25 Claims, 5 Drawing Sheets

LOW COST HIGH SPEED BOARD-TO-BOARD COAXIAL CONNECTOR DESIGN WITH CO-PLANAR WAVEGUIDE FOR PCB LAUNCH

BACKGROUND

1. Field of the Invention

The invention relates to board-to-board coaxial connections. More specifically, the invention relates to board-to-board coaxial connections in a computing environment.

2. Background

The combination of mobile computing and wireless communications is a powerful driver in the personal electronics field. Mobile computers, for example laptops, have improved connectivity with peripheral devices and the Internet through a wireless communication module. A wireless initiative to greatly improve the conductivity of mobile personal computers to the Internet and other devices is currently underway. Such an initiative requires a combination interface with both radio frequency (RF) and digital signal segments to provide conductivity, between mobile personal computers and peripheral devices. The RF segment typically contains several coaxial ("coax") connections, each of which is capable of handling RF signals up to 6 gigahertz (GHz).

Motherboards for mobile personal computers may contain within them radio frequency (RF) antennae. These antennae may be connected through the motherboard to an off board connection through microstrip lines. These microstrip lines need to be suitably engineered to provide appropriate impedance and isolation for the RF signal. Features that need to be considered in engineering RF capable microstrip transmission lines include width of line and distance between signal line and ground line and the dielectric layer separating them.

An add-on radio module is typically used to process information contained in a RF signal. The module board will have processing capability necessary to make the RF signal usable by the mobile personal computer motherboard. The module is thus able to extract the digital signal from the analog carrier.

A board-to-board RF connector is a two-piece connector. One piece of the board-to-board connector is permanently attached to the mobile personal computer motherboard, while the other piece of the connector is permanently attached to the RF module board. If desired, a radio frequency module may be connected onto the mobile personal computer motherboard by such a connector. However, the absence of the module will not interfere with the operation of the mobile personal computer motherboard.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Reference will now be made to drawings wherein like structures will be provided with like reference designations. In order to show the structures of the claims most clearly, the drawings included herein are diagrammatic representations of board connection structures. Thus, the actual appearance of the fabricated structures, for example in a photograph, may appear different while still incorporating the essential structures of the claims. Moreover, the drawings show only the structures necessary to understand the claims. Additional structures known in the art have not been included to maintain the clarity of the drawings.

Figure 1:
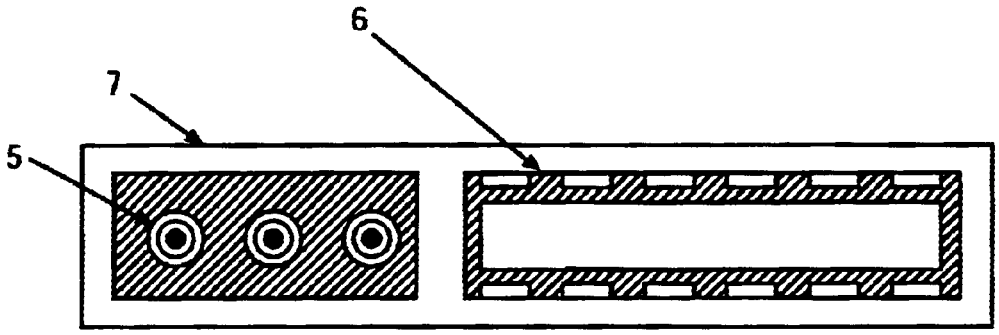
FIG. 1 is a schematic top view of one embodiment of a combination digital segment and radio frequency segment board-to-board connector.

FIG. 1 illustrates a schematic top view of one embodiment of a combination digital segment and radio frequency segment board-to-board connector. One half of the connector, for example the "male" half, is mounted to a mobile personal computer motherboard, while the other half, in this example the "female" half, is attached to an add-in card module. The male half and the female half mate to form a coaxial connection connecting the mobile computer motherboard with the add-in module board. In one embodiment, the add-in module may be an RF module. RF coax connections 5 are capable of handling RF signals with frequencies, in one embodiment according to current standards, of up to 6 GHz. The digital signal connector 6 is capable of handling a data rate, in one embodiment, of 480 megabits per second (Mbits/s). RF coax connections 5 and digital connection 6 are packaged together within housing 7.

Figure 1A:
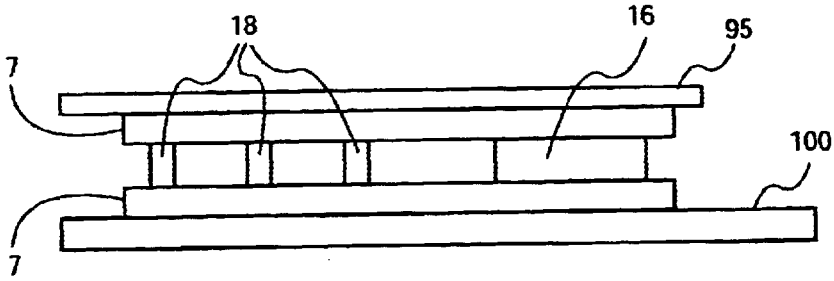
FIG. 1A is a schematic side view of one embodiment of a combination digital segment and radio frequency segment board-to-board connector.

FIG. 1A is a schematic side view of one embodiment of a combination digital segment and radio frequency segment board-to-board connector. RF module board 95, in one embodiment, is connected to digital signal connector 16, and three coaxial connectors 18. Digital signal connector 16 and coaxial connectors 18 connect RF module board 95 to motherboard 100. In one embodiment, a single RF coaxial connector 18 and digital signal connector 16 connect RF module board 95 to motherboard 100.

Figure 1B:
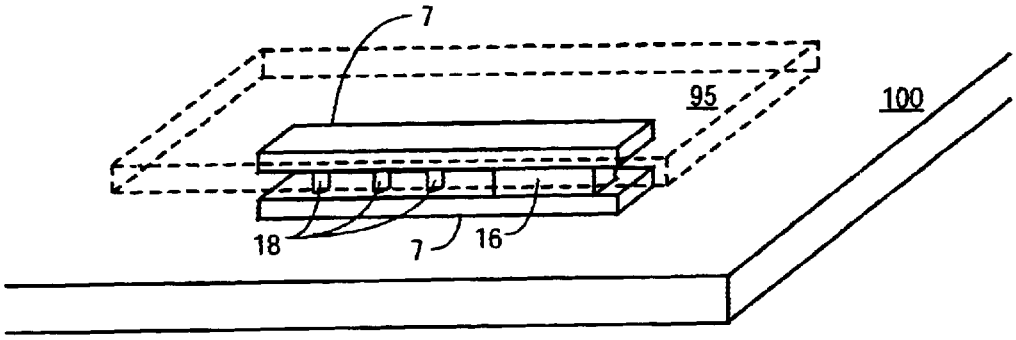
FIG. 1B is a schematic isometric view of one embodiment of a combination digital segment and radio frequency segment board-to-board connector.

FIG. 1B is a schematic isometric view of one embodiment of a combination digital segment and radio frequency segment board-to-board connector. RF module board 95 is connected to motherboard 100 by mated coaxial connectors 18 and mated digital signal connector 16. Additional supports, which may in one embodiment support RF module board 95 over motherboard 100 are not shown. RF module board 95 is shown in dashed lines, though, in one embodiment, it is superimposed over motherboard 100 to more clearly show the relationship between connectors 16 and 18 and boards 95 and 100. It is important to note motherboard 100 is not limited to use in a mobile computer. Motherboard 100 may in one embodiment be part of a desk top, or larger, computer.

Figure 2:
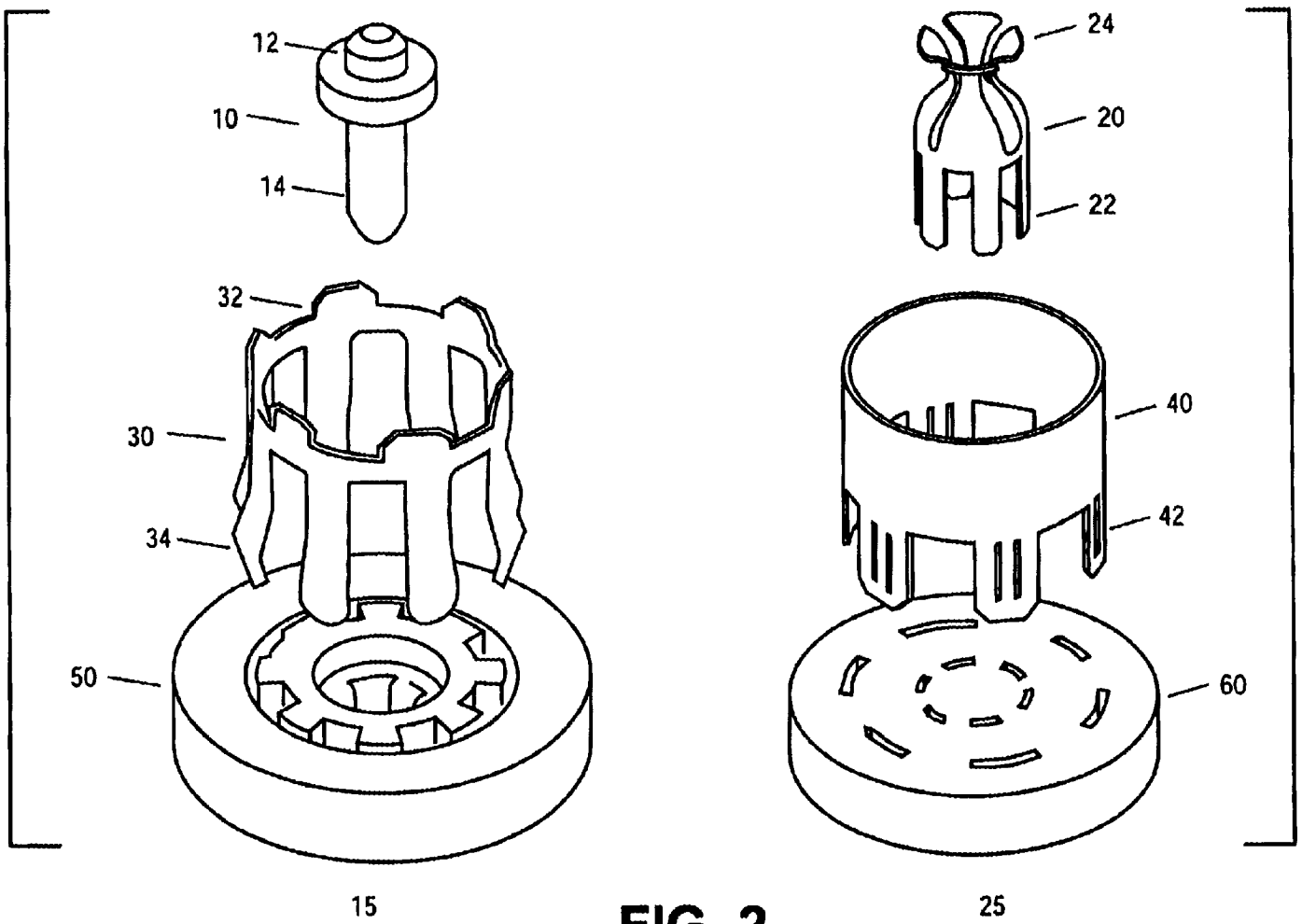
FIG. 2 is an exploded view of one embodiment of both male and female coax connectors.

FIG. 2 shows an exploded schematic view of male coax connector 15 and female coax connector 25. Male coax connector 15 comprises RF signal pin 10, outer or ground shield spring cage 30, and housing 50. RF signal pin 10 comprises signal plane contact 12, which in one embodiment can be soldered to module board 95. RF signal pin 10 also comprises signal pin insertion 14 for contacting signal receptacle spring 24. In one embodiment, RF signal pin 10 may be made from a copper alloy that is plated with a noble metal to prevent oxidation. Noble metals include, but are not limited to gold, platinum and palladium.

Male connector 15 of FIG. 2 also contains outer or ground shield spring cage 30. Ground shield spring cage 30 comprises module board ground plane contacts 32 and finger springs 34. In one embodiment, the module board ground plane contacts 32 may be through-hole soldered to a printed circuit board to make permanent contact to the ground plane in the printed circuit board. In another embodiment, module board ground plane contacts 32 may make connection with a surface ground, or a co-planar waveguide ground plane 80 (shown in FIG. 4) which then is connected to the ground plane in the printed circuit board through via holes 70 (shown in FIG. 4).

Ground shield spring cage 30, as shown in FIG. 2, typically is fabricated from a single sheet of metal. The sheet of metal may be stamped to cut away the extraneous parts of the sheet, and then what remains of the sheet is rolled, or formed into the configuration shown. Finger springs 34 are shaped such that their flexural compliance or rigidity enables them to maintain close contact with the interior cylindrical surface of outer ground shield barrel 40 of female coax connector 25. Representative materials for ground shield spring cage 30 are phosphor bronze, beryllium copper, or brass.

Housing 50 is designed to hold RF signal pin 10 and ground shield spring cage 30 in alignment relative to each other, while enabling easy assembly to the board. In one embodiment, RF signal pin 10 and outer shield spring cage 30 may be interference fitted into housing 50 to form male connector 15. It is to be understood, that housing 50 shows only that portion of housing 7 from FIGS. 1, 1A and 1B immediately surrounding the coax connector. The remainder of housing 7 is not shown to maintain the clarity of the drawing.

The number of finger springs 34 in ground shield spring cage 30 is a trade off between manufacturability and the desire to have a complete grounding shield around RF signal pin 10. The fewer finger springs 34 in the ground shield spring cage 30, the easier it is to manufacture. In contrast, having more finger springs 34 in shield spring cage 30, and the greater fraction of the cylindrical shell area the finger springs 34 comprise, increases the frequency at which the ground shield 30 for RF signal pin 10 may operate. In one embodiment, outer ground shield spring cage 30 will have between six and eight finger springs 34.

RF signal pin 10 fits tightly within signal receptacle 20. Signal receptacle 20 has an upper end with signal receptacle springs 24 whose opening, in one embodiment may form a shape reminiscent of a tulip. The deflection of the signal receptacle springs by the RF signal pin 10 ensures a reliable electrical contact. Signal receptacle 20 also has lower end signal plane contacts 22. In one embodiment, these signal plane contacts 22 may make connection with the signal line of the board that the female connector in the coaxial connection is attached to.

Signal receptacle 20, of female coax connector 25, shown in FIG. 2, in one embodiment, may be stamped out of a single sheet of metal. The sheet metal after stamping is then rolled, or formed to form the cylindrical base and the tulip-shaped top portion 24. The spring characteristic of signal receptacle springs 24 allows signal receptacle 20 to maintain a firm grasp on RF signal pin 10. In one embodiment, Representative materials for signal receptacle 20 are phosphor bronze, beryllium copper, or brass.

Outer or ground shield barrel 40, of female coax connector 25, shown in FIG. 2, surrounds signal receptacle 20 and forms a ground connection with male ground shield spring cage 30. Ground shield barrel 40 has ground plane contacts 42 that may, in one embodiment, contact a coplanar waveguide ground plane (80 in FIG. 4) on the board to which it is attached by via through holes to the microstrip ground plane in the printed circuit board. In another embodiment, ground plane contacts 42 of ground shield barrel 40 punch through the printed circuit board and make direct solder contact to the ground plane therein. Signal receptacle 20 and ground shield barrel 40, in one embodiment, may be press interference fit into housing 60.

Housing 60 maintains the position of signal receptacle 20 and ground shield barrel 40 relative to each other, and holds the female coaxial connector to the board. It is to be understood that housing 60 shows only that portion of housing 7 from FIGS. 1, 1A and 1B immediately surrounding the coax connector. The remainder of housing 7 is not shown to maintain the clarity of the drawing. In one embodiment, outer ground shield barrel 40 is stamped from a single sheet of metal. This metal may be a copper alloy. Once the copper alloy stamp is rolled to form the cylindrical shell, ground shield barrel 40 may be plated with a noble metal to prevent corrosion.

Figure 3:
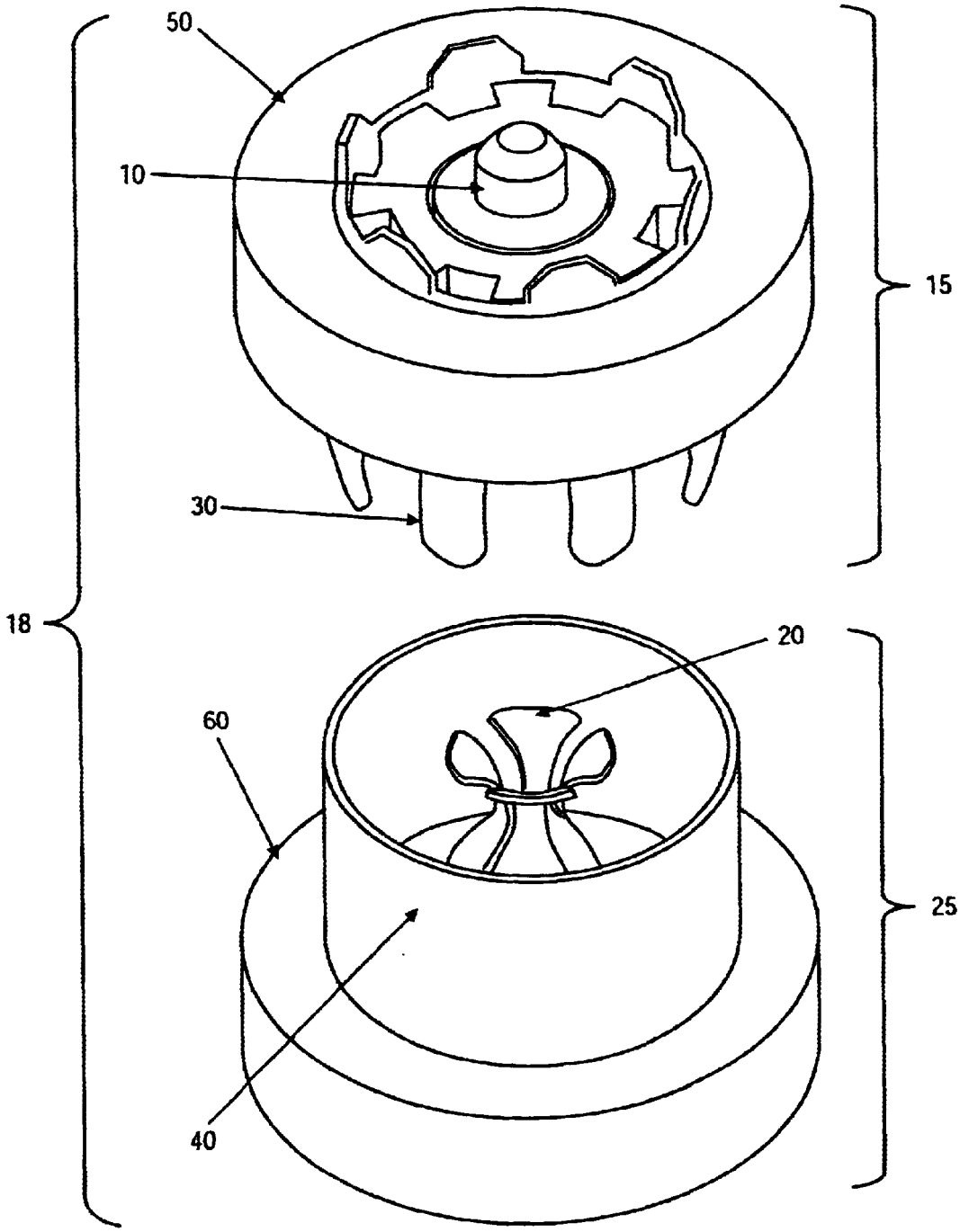
FIG. 3 is a schematic illustration juxtaposing the assembled connectors one over the other.

FIG. 3 illustrates one embodiment of how the male coaxial connector 15 and female coaxial connector 25 may be mated together to form coax connection 18. In FIG. 3, male coax connector 15 is shown positioned over female coax connector 25. Neither connector is shown attached to a board. Signal pin insertion 14 (not shown) of signal pin 10 connects with signal receptacle springs 24 of signal receptacle 20 of female coaxial connector 25. Finger springs 34 of ground shield spring cage 30 of male coaxial connector 15 contact the inside surface of ground shield barrel 40 upon mating. The deflection of finger springs 34 allow outer ground shield spring cage 30 to form a secure physical contact with outer ground shield barrel 40.

Figure 4:
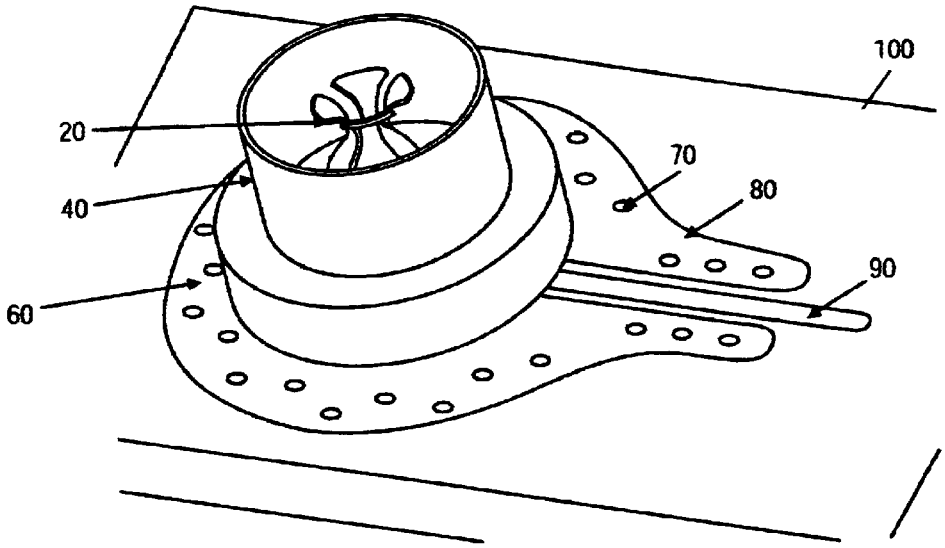
FIG. 4 is a schematic illustration showing one embodiment of connecting the RF coaxial connection through a co-planar waveguide transition on the surface of the board to the microstrip transmission line on the board.

FIG. 4 illustrates one embodiment of female connector 25 attached to a board. It is to be understood that the male connector may be attached to its board in a similar manner. In this embodiment, the board to which female coaxial connector 25 is attached is motherboard 100. Motherboard 100 contains a microstrip signal line 90 that connects to signal plane contacts 22 of signal receptacle 20. Surface ground, or co-planar waveguide ground plane 80 on the surface of motherboard 100 connects to ground plane contacts 42 of ground shield barrel 40. Typically, the surface of motherboard 100 is dedicated to signal lines, such as for example signal line 90. However, in this co-planar waveguide embodiment, a portion of the surface of motherboard 100 is dedicated to transitioning the microstrip ground plane embedded in the printed circuit board to surface ground 80 by use of the co-planar structure. Surface ground 80 is connected to the lower ground plane within printed circuit board 100 through multiple vias 70.

Figure 5:
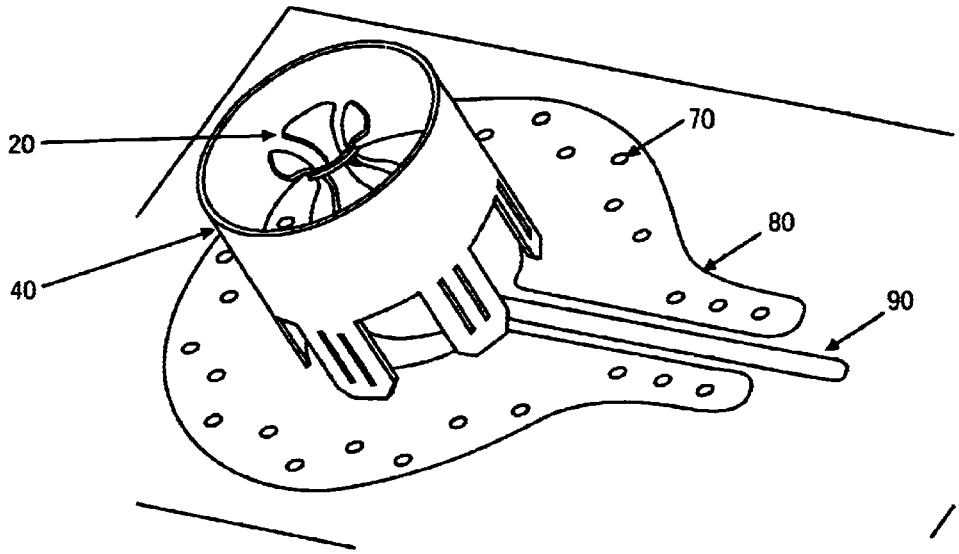
FIG. 5 is a schematic illustration giving a better indication of the ground connection to the co-planar waveguide ground plane.

FIG. 5 shows the co-planar waveguide of FIG. 4 with housing 60 removed for better illustration of the ground plane contact using co-planar waveguide ground plane 80. Outer ground shield barrel ground contacts 42 may form an electrical connection to co-planar waveguide ground plane

80. The ground signal may travel through co-planar waveguide ground plane 80 to the ground plane of printed circuit board 100 through vias 70.

The addition of the co-planar waveguide allows a more smooth transition from the microstrip transmission line to the coaxial connector of the claims. This transition allows a more continuous ground path for supporting the GHz transmission line.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

a combination digital signal and radio frequency connector for directly coupling a motherboard to a radio frequency module board;

a spring cage and a barrel: and a spring cage and barrel connection surrounding a ground line, wherein a ground connection from the spring cage and a ground connection from the barrel are each coupled to a surface co-planar waveguide ground on their respective motherboard and radio frequency board.

2. The apparatus of claim 1, further comprising a pin and receptacle connection for a signal line in the radio frequency connector.

3. The apparatus of claim 2, wherein the receptacle comprises a sheet of metal stamped and rolled into a tulip shape.

4. The apparatus of claim 1, wherein the spring cage and barrel comprise a sheet metal stamped and rolled into a substantially cylindrical form.

5. The apparatus of claim 1, wherein the spring cage comprises finger springs having flexural compliance that retains a close contact against an inner surface of the barrel upon mating.

6. An apparatus comprising:

a radio frequency board having a combination digital signal and radio frequency connector adapted for directly coupling to a motherboard for a computer;

a spring cage and a barrel; and a spring cage and barrel connection surrounding a around line, wherein a ground connection from the spring cage and a ground connection from the barrel are each coupled to a surface co-planar waveguide ground on their respective radio frequency board and motherboard for a computer.

7. The apparatus of claim 6, further comprising a pin and receptacle connection for a signal line in the radio frequency connector.

8. The apparatus of claim 7, wherein the receptacle comprises a sheet of metal stamped and rolled into a tulip shape.

9. The apparatus of claim 6, wherein the spring cage and barrel comprise a sheet of metal stamped and rolled into a substantially cylindrical form.

10. The apparatus of claim 6, wherein the spring cage comprises finger springs having flexural compliance that retains a close contact against an inner surface of the barrel upon mating.

11. An apparatus comprising:

a pin and receptacle connection for transferring a signal coupled between a radio frequency module compatible with a first mobile computer motherboard and a second motherboard in a mobile computer;

a spring cage and a barrel; and a spring cage and barrel connection coupled around the pin and receptacle connection for transferring a ground; and a radio frequency coaxial direct board to board connection, wherein a ground connection from the spring case and a ground connection from the barrel are each coupled to a surface co-planar waveguide ground on the respective first and second mobile computer motherboards.

12. The apparatus of claim 11, wherein the receptacle comprises a sheet metal stamped and rolled into a tulip shape.

13. The apparatus of claim 11, wherein the receptacle and the spring cage are made from at least one of phosphor bronze, beryllium copper and brass.

14. The apparatus of claim 11, wherein the pin and barrel comprise a copper alloy.

15. The apparatus of claim 14, wherein copper alloy is plated to avoid corroding.

16. The apparatus of claim 11, wherein the spring cage and barrel comprise a sheet metal stamped and rolled into a substantially cylindrical form.

17. The apparatus of claim 11, wherein the spring cage comprises finger springs having flexural compliance that retains a close contact against an inner surface of the barrel upon mating.

18. The apparatus of claim 11, wherein the coplanar waveguide grounds are coupled to their respective printed circuit board ground planes by vias in the boards.

19. An apparatus comprising:

a direct board to board coaxial connection having a male portion and a female portion, wherein one of the male portion and female portion is coupled to a computer motherboard having a ground plane and the other of the male portion and female portion is coupled to a radio frequency module card having a ground plane, such that the radio frequency module card is removeably coupled to the computer motherboard by the direct board to board coaxial connection, wherein the direct board to board coaxial connection comprises a pin and receptacle connection for transferring a signal and a spring cage and barrel connection for transferring a ground signal; and a spring case and a barrel, wherein the spring cage and barrel transfer the ground signal to a surface co-planar waveguide ground and then to the ground plane of the motherboard and the ground plane of the radio frequency module card through vias.

20. A method comprising:

forming a signal pin;

stamping a ground shield spring cage from a sheet of metal;

rolling the ground shield spring cage to form a cage with finger springs for gripping the inside of a ground barrel;

stamping a ground barrel from a sheet of metal;

rolling the ground barrel into a cylinder;

stamping a signal pin receptacle from a sheet of metal;

rolling the signal pin receptacle to form a cylinder with a spring end that resembles a tulip;

plating the pin and the barrel;

assembling the signal pin, ground spring cage, and a housing to form a male coaxial connector by press interference fitting, wherein a around connection from the ground spring cage is coupled to a surface co-planar waveguide ground; and assembling the signal pin receptacle, ground barrel and a housing to form a female coaxial connector by press interference fitting, wherein a ground connection from the ground barrel is coupled to a surface co-planar waveguide ground.

21. The method of claim 20, further comprising:

fabricating the ground shield spring cage and signal pin receptacle from one of the group comprising phosphor bronze, beryllium copper, or brass.

22. The method of claim 21, further comprising:

fabricating the signal pin and outer ground shield from a copper alloy.

23. A method comprising:

aligning a radio frequency module board compatible with a computer motherboard with a computer motherboard; and connecting the radio frequency module board to the motherboard of a computer using direct board to board radio frequency coaxial connectors wherein the connectors comprise a signal pin, a signal pin receptacle, a ground shield spring cage and a ground shield barrel; and the signal pin receptacle, ground shield spring cage and ground shield barrel are fabricated from stamped sheets of metal; and coupling a ground connection from the ground shield cage and ground shield barrel to a surface co-planar waveguide ground.

24. The method of claim 23, further comprising:

coupling the signal pin to the signal pin receptacle to form a signal line connection between the radio frequency module board and the computer motherboard.

25. The method of claim further comprising:

coupling the ground shield spring cage to the ground shield barrel to form a ground shield connection for a signal line connection between the radio frequency module board and the computer motherboard.

* * * * *

UNITED STATES PATENT AND TRADEMARK OFFICE

CERTIFICATE OF CORRECTION

PATENT NO. : 6,700,464 B2
APPLICATION NO. : 10/081515
DATED : March 2, 2004
INVENTOR(S) : Ling et al.

It is certified that error appears in the above-identified patent and that said Letters Patent is hereby corrected as shown below:

In column 5, at line 46, delete “around” and insert --ground--.

In column 6, at line 9, delete “case” and insert --cage--.

In column 8, at line 16 immediately after “claim”, insert --23--.

Signed and Sealed this

Eighth Day of January, 2008

JON W. DUDAS
*Director of the United States Patent and Trademark Office*